US007329094B2

(12) United States Patent
Zies et al.

(10) Patent No.: US 7,329,094 B2
(45) Date of Patent: Feb. 12, 2008

(54) PRODUCTION OF MACHINE PARTS PROVIDED WITH A MINERAL CASTING

(75) Inventors: Gero Zies, Lüdinghausen (DE); Günter Zarges, Witten (DE)

(73) Assignee: Dü chting Pumpen Maschinenfabrik GmbH & Co. KG, Witten (DE)

( * ) Notice: Subject to any disclaimer, the term of this patent is extended or adjusted under 35 U.S.C. 154(b) by 0 days.

(21) Appl. No.: 10/528,536

(22) PCT Filed: Sep. 19, 2002

(86) PCT No.: PCT/EP02/10513

§ 371 (c)(1),
(2), (4) Date: Mar. 21, 2005

(87) PCT Pub. No.: WO2004/033919

PCT Pub. Date: Apr. 22, 2004

(65) Prior Publication Data

US 2005/0241793 A1 Nov. 3, 2005

(51) Int. Cl.
*F04D 7/04* (2006.01)

(52) U.S. Cl. ..... 415/197; 415/915

(58) Field of Classification Search ..... 415/196, 415/197, 176, 177, 915, 71; 264/264
See application file for complete search history.

(56) References Cited

U.S. PATENT DOCUMENTS 3,607,600 A * 9/1971 Schreter et al. ..... 415/197
4,234,291 A * 11/1980 Hurst et al. ..... 415/197
5,513,954 A 5/1996 Bourgeois
5,795,514 A 8/1998 Dütching et al.

FOREIGN PATENT DOCUMENTS

DE 40 12 041 A1 10/1991
DE 43 43 547 C1 11/1994
DE 297 23 409 U1 10/1998

OTHER PUBLICATIONS

International Search Report.

* cited by examiner

*Primary Examiner*—Richard A. Edgar
(74) *Attorney, Agent, or Firm*—Collard & Roe, P.C.

(57) ABSTRACT

The invention relates to a method for the production of machine parts which are at least partially provided with a mineral casting. The mineral casting is carried out in a liquid state in at least one part of a housing element (1, 2) of the machine part acting as a casting mould, such that the mineral casting, after hardening, forms a lining element adapted to the inner contour of the housing element (1, 2). The aim of the invention is to enable the mineral cast lining elements (5) to be adapted as accurately as possible to the inner contour of the outer housing (1, 2) without any risk of destroying the mineral cast body (5) occurring when pumps are produced or operated. According to the invention, the inner surfaces of the housing element (1, 2) are treated with a separating means (3) prior to the casting out operation.

11 Claims, 3 Drawing Sheets

PRODUCTION OF MACHINE PARTS PROVIDED WITH A MINERAL CASTING

CROSS REFERENCE TO RELATED APPLICATIONS

Applicants claim priority under 35 U.S.C. §365 of PCT/EP2002/010513 filed Sep. 19, 2002. The international application under PCT article 21(2) was not published in English.

The invention relates to a method for the production of machine parts at least partially lined with a mineral casting, whereby the mineral casting is cast into one housing element of the machine part acting as a casting mold, so that the mineral casting forms a lining element that is adapted to the inner contour of the housing element, after it hardens.

A highly corrosion-resistant and wear-resistant mineral casting for the production of monolithically cast pump housings or pump parts is known from DE 43 43 547 C1, for example.

A centrifugal pump for chemically aggressive, erosive or abrasive materials is known from DE 297 23 409 U1, which pump can be produced according to the method stated initially. In the case of the previously known pump, the mantle housing itself is used as part of the casting mold, and the mineral casting is cast into it. This has the advantage that unmolding is eliminated and the lining elements of the pump housing formed by the casting remain in place in the housing part. In this manner, a laminate part of the metallic mantle housing and the lining element consisting of the mineral casting is formed.

The production of machine parts lined with mineral casting, according to the method proposed in DE 297 23 409 U1, has a number of disadvantages. This is because unavoidable reaction losses occur when the mineral casting hardens, so that the mineral casting body rigidly connected with the metallic mantle housing can develop cracks, because of its low tensile strength. In the case of binders that harden under the effect of supplied heat, there is also the problem that if the dimensions of the mantle housing, i.e. of the mineral casting body, are large, damage can occur during cooling, due to the different heat conductivity and the thermal expansion coefficients. Comparable problems also occur in the operation of centrifugal pumps of the previously known type, if expansions of the pump housing occur due to dynamic stress. In the case of larger pumps, expansions of several millimeters are not rare, and this necessarily leads to the result that the brittle mineral casting bodies that are rigidly connected with the outer housing are destroyed.

The present invention is based on the task of further developing the previously known method in such a manner that the disadvantages mentioned are eliminated. In particular, a method is to be created by the invention, with which pump housings for centrifugal pumps can be produced, in which the lining parts consisting of mineral casting are adapted to the inner contour of the mantle housing as precisely as possible, without there being a risk that destruction of the mineral casting bodies will occur during the production or operation of the pumps.

This task is accomplished, proceeding from a method of the type stated initially, in that the inner surfaces of the housing element are treated with a parting agent before casting takes place.

The method according to the invention has the following advantages:

Because no rigid connection between the lining element and the housing element exists, because of the use of the parting agent, destruction of the mineral casting body due to temperature differences between the housing element and the lining element cannot occur. The different heat expansion provoked by the temperature differences can be absorbed by the gap between the housing element and the lining element that is produced by the parting agent.

In addition, destruction caused by possible expansions of the machine part is prevented.

In the production of pump housings according to the method according to the invention, the parting agent layer ensures that no ions from the transported medium can diffuse through the mineral casting into the housing material. The diffusion of ions into the housing material could trigger disadvantageous chemical reactions in the housing material, and could burst the mineral casting layer due to a volume increase, or could weaken the outer material.

When using the parting agent, it is furthermore assured that the mineral casting will adapt to the inner contour of the housing element over its entire surface. A large-area transfer of force from the lining element to the outer housing is assured, without any reworking of the casting body or the inner contour of the housing element.

In the method according to the invention, the wall thickness of the lining element can be predetermined, in practical manner, by a core that is located in the housing element during the casting process. The core that is used as part of the casting mold, which determines the inner contour of the lining element, is removed after the mineral casting has hardened, either partially or completely.

For machine parts that are supposed to be protected from abrasion, erosion, or corrosion, in particular, as this is the case, for example, for centrifugal pumps for correspondingly abrasive, erosive, or corrosive materials, it is practical to use a mixture having a binder with a filler as the mineral casting, whereby the filler is a fine-grained wear-resistant and corrosion-resistant material, such as, in particular, silicon carbide, quartz sand, glass, ceramic, or a mixture of these materials. To optimize the chemical resistance and wear resistance, the mixture should contain as much filler and as little binder as possible.

It is advantageous to use a synthetic resin hardener system that cures when heat is applied as the binder, in the method according to the invention. In this manner, it is possible to influence the curing process in targeted manner. The mineral casting mixture can be kept sufficiently liquid during the mixing and casting process so that it can then be cured by means of targeted heating. Suitable synthetic resin hardener systems are available as commercial products.

A practical further development of the method according to the invention results if the housing element has anchoring means that project into the mineral casting. This term is used to refer to any kind of positive-lock connection between the housing part and the lining part that prevents the mineral casting body from falling out of the housing part, for example. This can also be prevented by recesses in the housing part in which the mineral casting that is cast in can anchor itself. In order for the mineral casting shell to remain removable, despite this, the anchoring means, for example also a wall element of the housing part provided with a corresponding pocket, can be configured to be releasable from the housing part by means of a suitable screw connection.

As described above, the method according to the invention is particularly suitable for the production of pump housings of centrifugal pumps. The housing element, in this case, is a mantle housing part of a spiral housing of a centrifugal pump.

In this connection, it is practical to proceed according to the following method steps:

First, at least two mantle housing parts connected with one another, treated with the parting agent on the inner surface, have the mineral casting cast into them, whereby a core is located in the interior of the mantle housing parts, which predetermines the wall thickness of the lining element during the casting process. After the mineral casting has hardened, partially or completely, the mantle housing parts are separated from one another, whereupon the core that is surrounded at least in part by the one-piece lining element can be destroyed and removed. Finally, the mantle housing parts are joined together again. This method of procedure has the advantage that the mineral casting lining of the spiral housing consists of a single part. This means that a mutual seal of the lining elements of the housing parts, in each instance, is not necessary. However, it is disadvantageous that the core, by means of which the shape of the impeller chamber of the centrifugal pump is predetermined, is enclosed in the mineral casting body after the casting process, so that the core must be destroyed and cannot be reused.

As an alternative to this, a method of procedure according to the following method steps is possible: First, at least two mantle housing parts treated with the parting agent on their inner surface have the mineral casting cast into them individually, whereby the wall thickness of the lining elements is predetermined, during the casting process, by a core, in each instance. After the mineral casting has hardened partially or completely, the core is removed. Then the mantle housing parts lined with the mineral casting are joined together, whereby the sealing surfaces of the lining elements are sealed. In this manner, the core can be used multiple times. Preferably, elastic seals are used for the seal.

Because the mantle housing parts have the casting cast into them individually, according to the method last described, there is the advantageous possibility of configuring the casting mold formed by the mantle housing parts and the core, in each instance, in such a manner that the lining elements project out of the mantle housing parts by several millimeters in the region of the sealing surfaces. When the spiral housing parts produced according to the invention are joined together and screwed together, the sealing surfaces of the lining elements can therefore be pressed against one another with great force. In addition, the lining elements are pressed firmly against the mantle housing parts from the inner, in this manner, thereby guaranteeing a good transfer of force from the transport medium to the outer housing.

Alternatively, the casting mold formed by the mantle housing parts and the core, in each instance, can be configured in such a manner that the lining elements lie behind the screw connection collars or the mantle housing parts in the region of the sealing surfaces, or end flush with them. In this case, only the forces that are provoked by the elastic seals are transferred to the lining elements, thereby also making it possible to guarantee secure contact of the mineral casting bodies to the inner surfaces of the mantle housing parts.

According to the previously described method, a centrifugal pump can be produced that has at least one impeller and at least one impeller chamber that accommodates the impeller, which chamber is lined at least in part with lining elements of mineral casting, whereby the lining elements are surrounded by a metallic mantle housing that consists of at least two mantle housing parts into which the lining elements are cast. According to the invention, the centrifugal pump is characterized in that a gap filled with a parting agent exists between the outer surfaces of the lining elements and the inner surfaces of the mantle housing parts.

Exemplary embodiments of the invention will be explained in the following, using the figures. These show:

Figure 1:
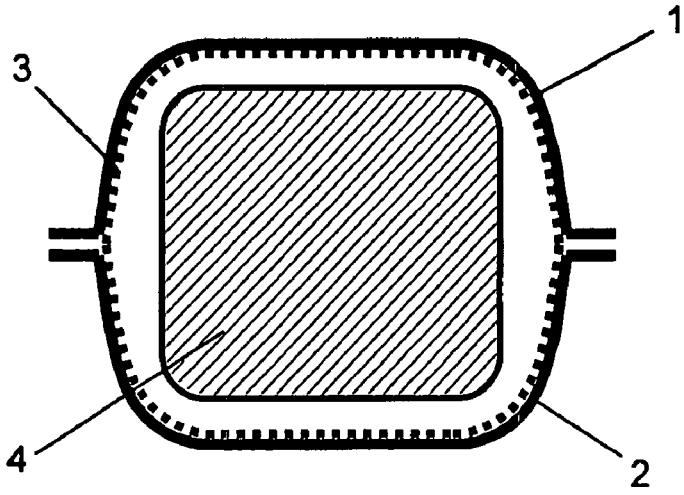
FIGS. 1 to 3 are schematic representations of the production of a spiral housing for a centrifugal pump, according to a first variant of the method according to the invention.
Figure 2:
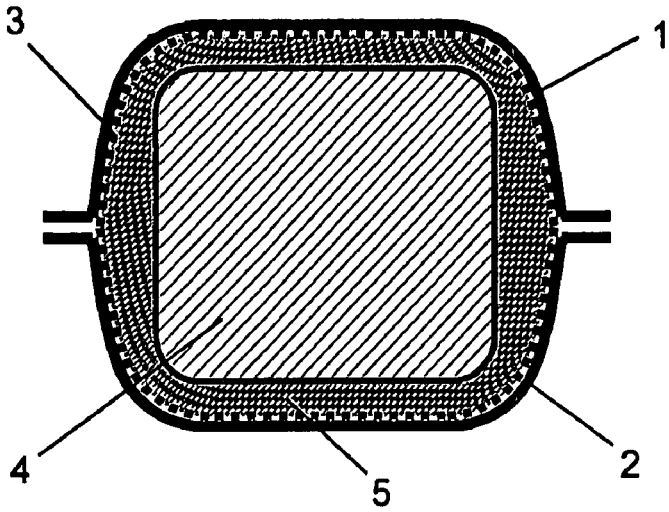
Figure 3:
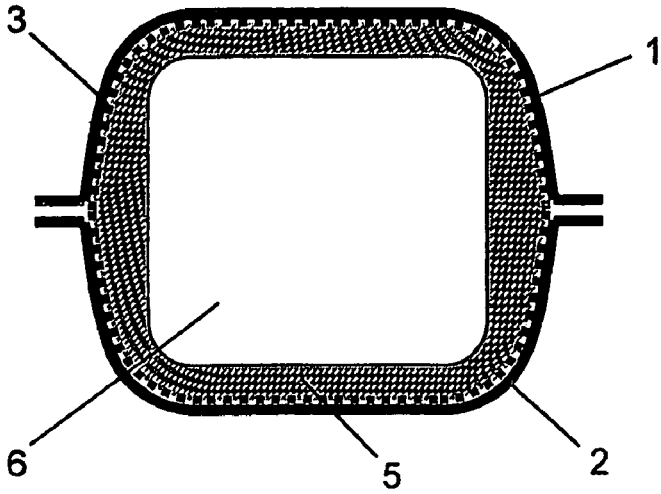

The production process shown schematically in FIGS. 1-3 proceeds from two metallic mantle housing parts 1 and 2 of the spiral housing of a centrifugal pump, which are connected with one another. The inner surfaces of the housing elements 1, 2 are pretreated with a parting agent. FIGS. 1-3 show a parting agent layer 3 with a broken line. In the production of spiral housings for centrifugal pumps, the use of a liquid parting agent based on wax has proven itself. The commercially available "Trennmittel [parting agent] T2" from the company Ebalta Kunststoff GmbH is particularly suitable, for example. As shown in FIGS. 1-3, there is a core 4 in the interior of the cavity formed by the connected mantle housing parts 1, 2. FIG. 1 shows the state of the casting mold formed by the mantle housing parts 1, 2 that are connected with one another, and by the core 4, before the casting process. According to FIG. 2, the interstice between the housing elements 1, 2 and the core 4 is filled with mineral casting after the casting process. The mineral casting body forms a lining element 5 that is adapted to the inner contour of the mantle housing parts 1, 2, the inner contour of which element is predetermined by the core 4. After the mineral casting has hardened, partially or completely, the core 4 is destroyed and removed. FIG. 3 shows the final state of the production process. After the core 4 has been removed, a cavity 6 surrounded by the lining element 5 remains, which cavity forms the impeller chamber of the centrifugal pump. The parting agent layer 3 that remains between the mantle housing parts 1, 2 and the lining element 5 ensures that the lining element 5 is not rigidly connected with the outer housing. Accordingly, destruction of the lining element 5 due to temperature differences between the mantle housing parts 1, 2 and the lining element 5 cannot occur. The different heat expansion provoked by possible temperature differences can be absorbed by a gap that was formed between the parting agent layer 3 and the lining element 5, or by the parting agent layer 3 itself. The production method described furthermore ensures that a large-area transfer of force from the lining element 5 to the outer housing formed by the mantle housing parts 1, 2 is guaranteed, without any reworking of the lining element 5 or the inner contour of the mantle housing parts 1, 2.

Figure 4:
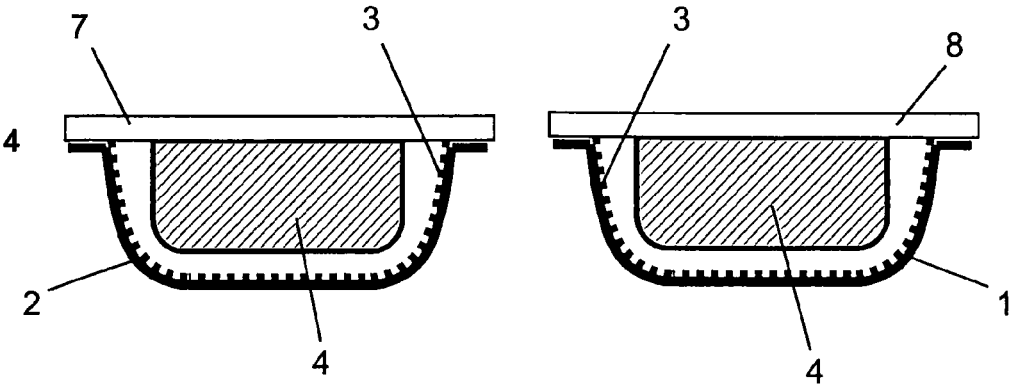
FIGS. 4 to 7 are schematic representations of the production of a spiral housing for a centrifugal pump, according to a second variant of the method according to the invention.
Figure 5:
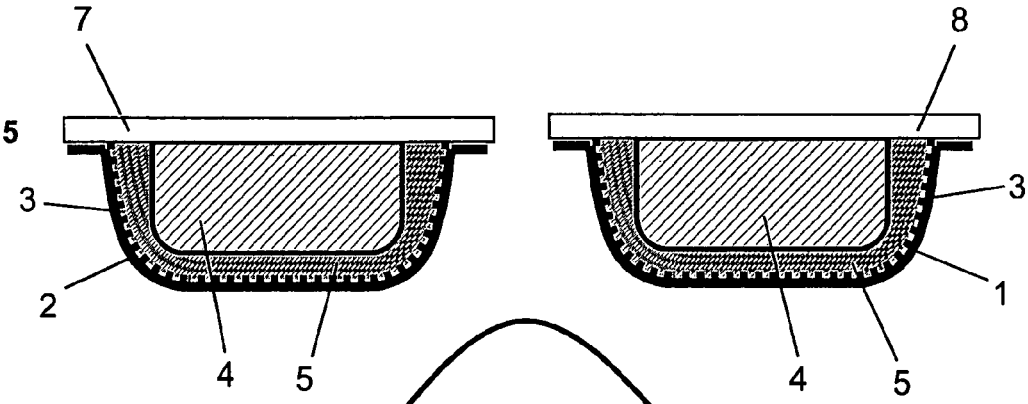
Figure 6:
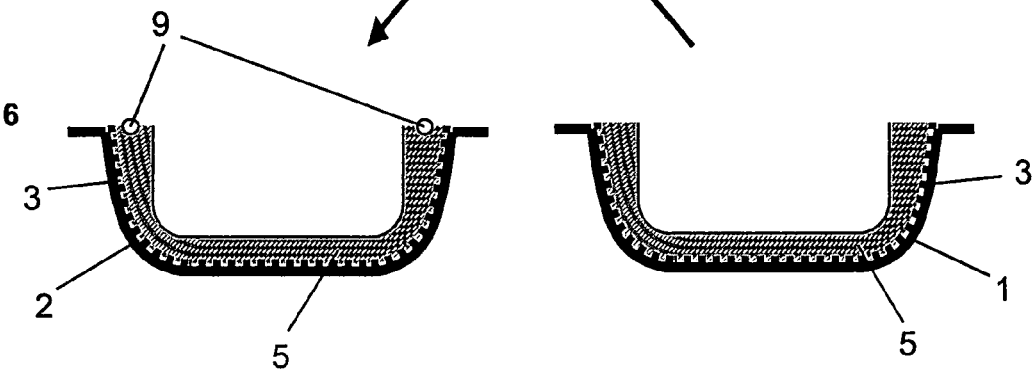
Figure 7:
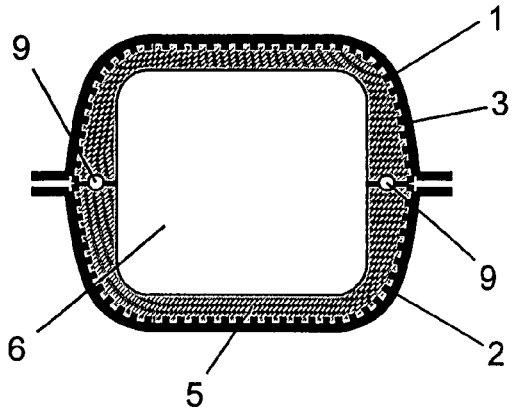

In the case of the production method shown schematically in FIGS. 4 to 7, two separate casting molds are used, which consist of the upper mantle housing part 1 and the lower mantle housing part 2, respectively. The two mantle housing parts 1, 2 are covered by a plate 7 or 8, respectively, in each instance, to which a part of the core 4 is attached, in each instance. Both mantle housing parts 1, 2 have been pretreated with parting agent on their inner surfaces. FIG. 4 shows the casting molds with the parting agent layer 3 before the casting process. The two mantle housing parts 1, 2 have mineral casting cast into them individually, whereby again, the wall thickness of the lining element 5 formed by the mineral casting body, in each instance, as shown in FIG. 5, is predetermined by the core 4. After the mineral casting has hardened partially or completely, the core 4, which is reusable in the method shown in FIGS. 4-7, and the plates 7, 8 are removed, in each instance. The mantle housing parts 1, 2 lined with mineral casting are in this state in FIG. 6. The sealing surfaces of the lining element 5 of the lower mantle housing part 2 are sealed with elastic sealing elements 9, so that the upper mantle housing part 1 can be set on. FIGS. 4-7 show the final state of the spiral housing consisting of the joined mantle housing parts 1, 2. The impeller chamber 6 is surrounded by two lining elements 5 that are sealed, relative to one another, by means of the sealing elements 9, and are not rigidly connected with the metallic mantle housing parts 1, 2 because of the parting agent layer 3.

Figure 8:
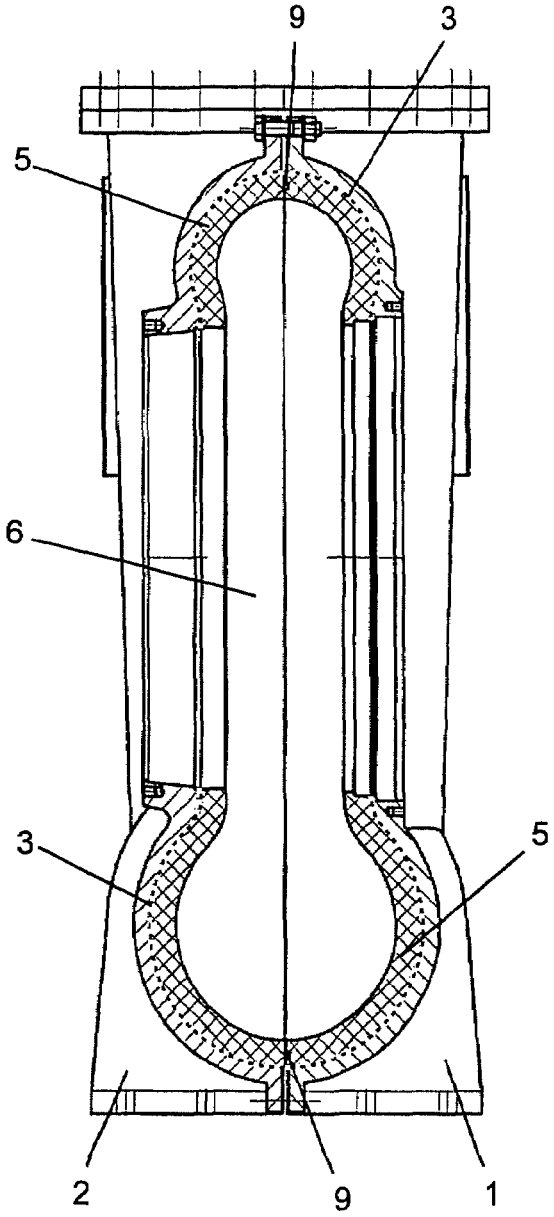
FIG. 8 is a cross-sectional representation of a spiral housing for a centrifugal pump, according to the invention.
Figure 9:
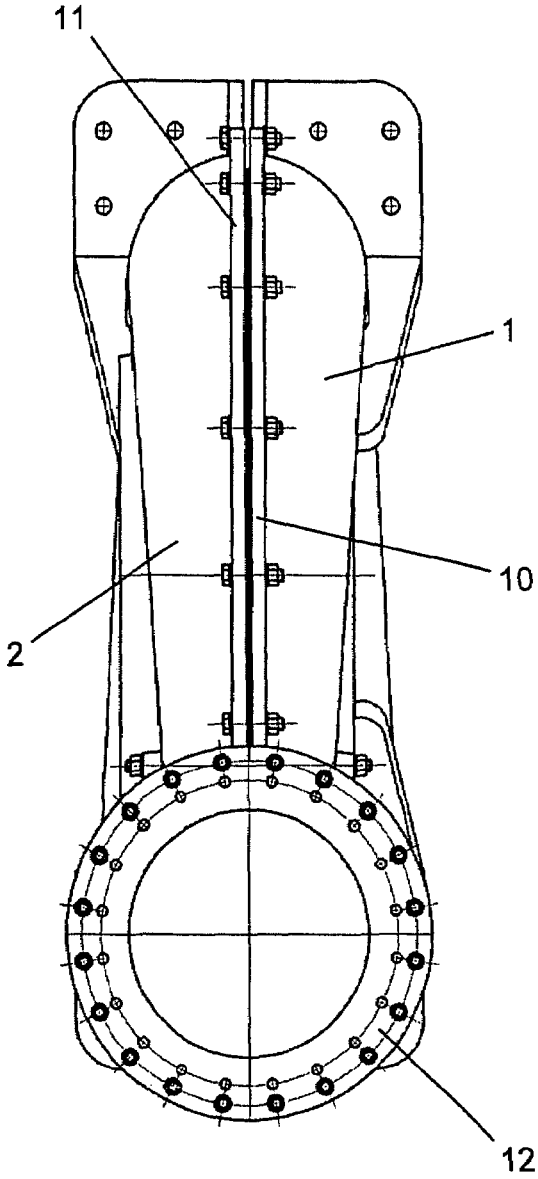
FIG. 9 is a top view of the spiral housing according to FIG. 8.

FIGS. 8 and 9 show a spiral housing of a centrifugal pump that consists of two metallic outer mantle housing parts 1 and 2. The impeller of the centrifugal pump, not shown in the figures, is accommodated by the impeller chamber 6, which is partially lined with lining elements 5 made of mineral casting. The parting agent layer 3 that lies between the outer surfaces of the lining elements 5 and the inner surfaces of the mantle housing parts 1, 2 is shown with a broken line in FIG. 8; it ensures that no rigid connection exists between the mantle housing parts 1, 2 and the lining elements 5. Sealing elements 9 are disposed between the sealing surfaces of the lining elements. At the same time, it can be seen in FIG. 8 that the lining elements 5 are accommodated in the mantle housing parts 1, 2 with a positive lock. FIG. 9 furthermore shows screw connection collars 10, 11 of the mantle housing parts 1, 2, as well as a connecting flange 12 for the outlet of the centrifugal pump.

The invention claimed is:

1. A method for the production of machine parts at least partially lined with a mineral casting, whereby the mineral casting is cast into at least one housing element of the machine part acting as a casting mold, so that the mineral casting forms a lining element that is adapted to the inner contour of the housing element, after it hardens, wherein the inner surfaces of the housing element are treated with a parting agent before casting occurs.

2. The method according to claim 1, wherein the wall thickness of the lining element is predetermined by a core that is located in the housing element during the casting process.

3. The method according to claim 1, wherein a mixture of a binder with a filler is used as the mineral casting, whereby the filler is a finegrained wear-resistant and corrosion-resistant material.

4. The method according to claim 3, wherein a synthetic resin hardener system that cures when heat is applied is used as the binder.

5. The method according to claim 3 wherein the filler is selected from the group consisting of silicon carbide, quartz sand, glass, ceramic, and a mixture of these materials.

6. The method according to claim 1, wherein the housing element is a mantle housing part of a spiral housing of a centrifugal pump.

7. The method according to claim 6, comprising the following method steps:

at least two mantle housing parts that are connected with one another and have been treated with the parting agent on their inner surface have the mineral casting cast into them, whereby a core is located in the interior of the mantle housing parts, which predetermines the wall thickness of the lining element during the casting process;

after the mineral casting has hardened, partially or completely, the mantle housing parts are separated from one another;

the core that is surrounded at least partially by the one-piece lining element is destroyed and removed;

the mantle housing parts are joined together again.

8. The method according to claim 6, comprising the following method steps:

at least two mantle housing parts that have been treated with the parting agent on their inner surface have the mineral casting cast into them, whereby the wall thickness of the lining element is predetermined by a core during the casting process, in each instance;

after the mineral casting has hardened, partially or completely, the core is removed;

the mantle housing parts lined with the mineral casting are joined together, whereby the sealing surfaces of the lining elements are sealed.

9. The method according to claim 8, wherein the casting mold formed by the mantle housing parts and the core, in each instance, is configured in such a manner that the lining elements project out of the mantle housing parts by several millimeters in the region of the sealing surfaces.

10. The method according to claim 8, wherein the casting mold formed by the mantle housing parts and the core, in each instance, is configured in such a manner that the lining elements lie behind the screw connection collars of the mantle housing parts, or end flush with them.

11. A centrifugal pump having at least one impeller and at least one impeller chamber that accommodates the impeller, which chamber is lined at least in part with lining elements of mineral casting, whereby the lining elements are surrounded by a metallic mantle housing that consists of at least two mantle housing parts into which the lining elements are cast, wherein a gap filled with a parting agent exists between the outer surfaces of the lining elements and the inner surfaces of the mantle housing parts.

* * * * *